ably smaller than the outside diameter of anode post 12. Plastic flange 48 is pressfitted onto anode post 12 to form a substantially permanent connection between plastic flange 48 and anode post 12. Alternatively, plastic flange 48 may be sealed to anode post 12 with a suitable plastic adhesive (not shown).

In the embodiment of FIG. 3, each anode post 12 having plastic flange 48 secured thereto is inserted into conductor opening 24. A suitable mastic layer 51, such as asphalt is applied to conducting layer top 20 and around anode post 12. Solder 26 is applied to conductor layer opening 24 to obtain electrical contact and secure the anode post in conducting layer 17. A suitable cement such as furan cement 49 is applied under pressure through cement openings 50 in interior layer 16 until the cement contacts plastic flange 48, anode post 12 and mastic layer 51. Curing of the cement provides a liquid-tight seal between plastic flange 48, mastic layer 51 and interior layer 16.

Anode posts 12 of FIGS. 2 and 3 may be installed in a similar manner as described above with respect to the anode posts of FIG. 1, using a jig or individual anode installation.

It will be recognized by those skilled in the art that the embodiments presented in the FIGS. can be modified wherein the opening for each anode post in conducting layer 17 may not extend completely through the cell base, if desired.

If desired, a small key, (not shown) may be secured to the lower portion of each anode post for fitting into a corresponding key-way in each opening 24 in order to optimize the position of anode posts 12 in openings 24. Alternatively, the key may be positioned in opening 24 and the key-way in the side of the lower portion of anode posts 12.

If during the course of refurbishing the cell it is necessary to replace anode 10, solder 26 is melted, and anode 10 is withdrawn from the cell for renewal of metal surface 11. Another anode 10 may be installed in place of the one removed.

The number of anodes 10 in the cell will usually correspond to the number of diaphragm-coated cathodes in the cell. The electrodes are positioned in the cell alternately, generally in a vertical position, with one anode being next to and spaced apart from a cathode. The cathodes are generally secured to the side of the cell and the anodes are positioned with anode posts 12 in at least one substantially straight row across the cell base 15. The number of anodes in each row and the number of rows of anodes, which corresponds to the number of conductors 32 in each cell, is not critical. Generally, the number of anodes in a row may range from about 2 to about 50 and preferably from about 10 to about 35 anodes per row. The number of rows of anodes (or conductors 32) may range from 1 to about 10 and preferably from about 1 to about 6 rows of anodes per cell. In a cell of this type, chlorine is produced at the anode, hydrogen is produced at the cathode, and each gas is collected separately.

Conductor 32 is generally a copper bar having a rectangular-shaped cross section, which is generally an extension of the bus bar from an adjacent cell. If desired, in order to provide a substantial uniform current distribution in anode posts 12 extending throughout each straight row of anode posts, conductor 32 is tapered to provide decreasing thickness from the first anode post 12 in a given row to the opposite side of cell base 15. As a result, when conductor 32 is secured to a power source such as by securing it to an operative bus bar and current is fed to conductor 32 a relatively uniform current distribution is achieved in anode posts 12 in each straight row across cell base 15.

The relative thickness of interior layer 16 and conducting layer 17 may also be varied with the size and shape of the electrolytic diaphragm cell. In a typical cell design, interior layer 16 is about ¼ inch thick and conducting layer 17 is about 1 inch thick. However, the thickness of interior layer 16 may range from about ⅛ to about 1 inch, and the thickness of conducting layer 17 may range about ½ inch to about 2 inches or more. Thicknesses which provide the desired degree of support without undue expense are usually employed.

Various modifications may be made in the invention without being outside the scope of the invention. For example, anode posts 12 have been illustrated and described as being cylindrical in cross sectional area, but rectangular,square or other forms of cross sectional area may be used instead of cylindrical rods. In addition, flange 29 on anode posts 12 may be omitted, if desired.

The novel anode connection of this invention may also be used in other electrolytic cells, such as the chlorate type, where the diaphragm is omitted and the product is sodium chlorate, or in cells where the anode connections are through the side of the cell.

Advantages of using the novel conducting means and anode connection of this invention include the following:

1. Shortened anode posts 12 are less expensive than anode posts which extend through the cell base, with threaded extensions.
2. Good soldered electrical connections reduce power loss.
3. Improved seals reduce corrosion of cell base and anode posts by cell liquors.
4. Less expensive materials of construction and assembly means can be employed.

EXAMPLE

A diaphragm cell of the type disclosed in U.S. Pat. No. 2,447,547, issued to K. E. Stewart on Aug. 24, 1948, is modified to include the anode attachment means described in FIG. 1 and the conductor attachment means of FIG. 3.

A cell base having an overall dimension of 63 inches by 56¼ inches is constructed of a 1 inch copper plate as conducting layer 17 coated with a ¼ inch thick hard rubber interior liner, as interior layer 16. Two series of anode posts holes are drilled in the cell base. Each series of holes is positioned in a straight line equidistant and parallel to the center line of the base about 14 inches from the center line and 28 inches from each other. The center line of the cell base is perpendicular to the 63 inch side of the cell. Each series of holes contains 16 holes, the centers of which are approximately 3 inches apart, the last hole in each series being approximately 4¾ inches from the edge of the cell base. The diameter of each hole is 1.125 inches.

Thirty-two anodes are placed in these holes, each anode being comprised of a mesh portion secured to the central anode posts having a metal washer welded to the lower portion of the anode post. The mesh portion of each anode is approximately 24½ inches in width, 1¼ inches thick, and 18¼ inches in height, being secured at the center of its short dimension to an anode post having a diameter of approximately 1.125 inches. The length of these anode posts is approximately 27¾ inches and the

BIPOLAR ELECTROLYTIC FILTER PRESS CELL FRAME

BACKGROUND OF THE INVENTION

1. Field of the Invention

The present invention pertains to electrolytic filter press cells. More particularly, the present invention pertains to cell frames for electrolytic filter press cells. Even more particularly, the present invention pertains to cell frames for bipolar electrolytic filter press cells.

2. Prior Art

As is known to those skilled in the art, a cell frame comprises the basic repeat unit in an electrolytic filter press cell. The cell frame functions as a separator or barrier between the anode of one cell and the cathode of the adjacent cell. A linear series of cathodes, anodes and interposed cell frames constitutes a filter press cell, in toto.

The prior art is replete with a wealth of technology respecting filter press cells. Generally, however, the prior art has paid a great deal of attention to electrode construction, diaphragm materials and the like. On the other hand, little attention has been directed to the cell frame and means and methods for improving same.

In U.S. Pat. No. 3,836,448 there is disclosed a frame for a filter press cell which is divided into an upper zone and a lower zone. The upper zone is used to collect the gases evolved during the electrolytic process conducted in the lower zone. A plurality of apertures are formed in the frame structure to provide communication between the two zones. This reference, also, teaches the necessity of separate frames for the cathode and anode, as well as the need for the frames to be free of electrical insulating partitions. It is to be appreciated that the frame structure is complex in that separate frames for the anode and cathode must be provided. Also, the need to be free of electrical insulating partitions requires separate structure therefor. This renders such structure expensive to manufacture.

Also, U.S. Pat. No. 3,252,883, teaches a cell frame for an electrolytic diaphragm cell. The reference teaches laterally spaced outlets for the gases evolved during the electrolytic process. According to this reference, however, the diaphragm must occupy substantially the entire space within the frame. Thus, the frame cannot be utilized in an electrolytic process which does not utilize a diaphragm or where the diaphragm does not occupy the entire space within the frame. This negates any concept of a universally employable cell frame.

Other prior art background material can be found in U.S. Pat. Nos. 3,856,652; 3,855,104; 2,522,681; 1,366,090 and 3,647,672.

The present invention, as will be appreciated from the detailed description thereof, provides a cell frame which is useful in a multiplicity of electrolytic processes and which includes means for prolonging the useful life thereof as well as facilitating the installation thereof.

SUMMARY OF THE INVENTION

In accordance with the present invention there is provided a bipolar electrolytic filter press cell frame having electrolyte feed and product removal means associated with each electrolyte compartment.

In a first embodiment of the invention the lower section and upper section are segregated by a pressure bar extending across the cell frame. The pressure bar obviates the potentiality of cathode-produced gases from distorting the separator or barrier material. The frame is adapted to be employed in a plurality of different electrolytic processes. The upper section is offset on the anode to increase the depth of the anolyte compartment.

The present invention further includes improved means for sealing and handling the frames hereof.

For a more complete understanding of the present invention reference is made to the following detailed description and accompanying drawing. In the drawing like reference characters refer to like parts throughout the several views, in which:

DESCRIPTION OF THE PREFERRED EMBODIMENTS

Figure 1:
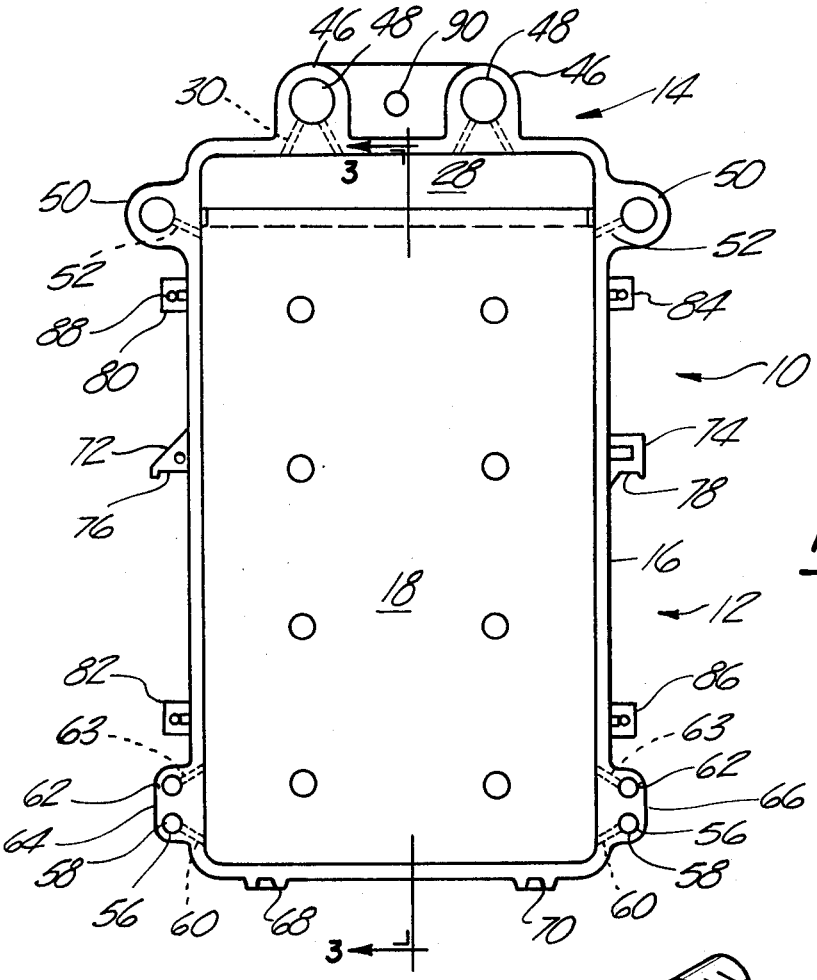
FIG. 1 is a front elevational view of an embodiment of an electrolytic filter press cell frame in accordance with the present invention.
Figure 2:
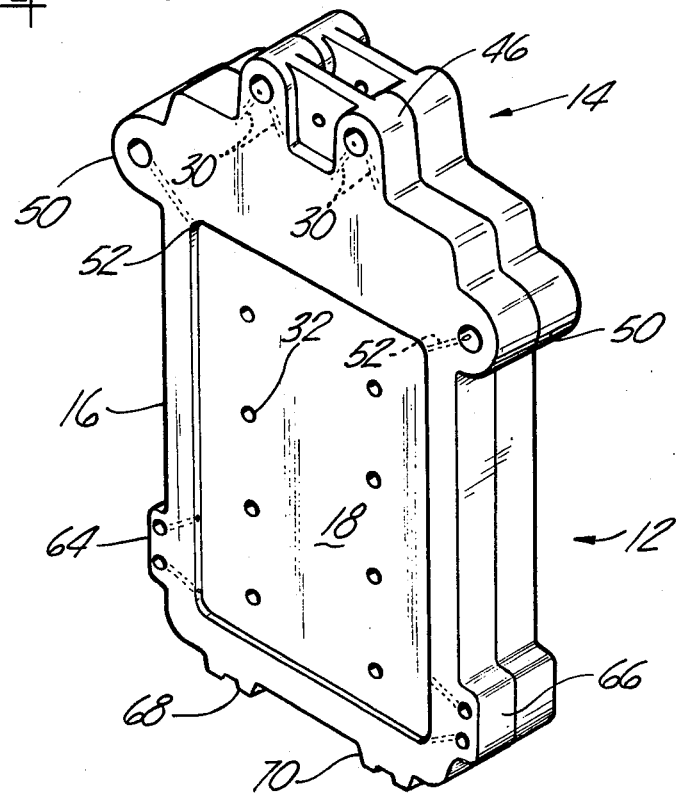
FIG. 2 is a perspective view of the electrolytic filter press cell frame of FIG. 1 with certain elements eliminated for purposes of clarity.

With reference to the drawing and in particular, FIGS. 1 and 2, there is depicted therein a bipolar electrolytic filter press cell frame, generally indicated at 10. The frame comprises a first or lower section or zone 12 and second or upper section or zone 14. The lower zone 12 defines the electrode area where the electrolytic solution is electrolyzed and the upper zone defines the means for collection or disengagement of the gaseous products.

With more particularity, the cell frame 10 comprises an integral unit which is injection molded or likewise formed from any suitable synthetic resinous material, which is compatible with the electrolytes being used, such as filled or unfilled polypropylene.

The frame is molded such that there is provided a peripheral rim 16 extending therearound and a recessed central web 18.

The area of the frame extending downwardly from the top of the web 18 defines the lower zone of the frame.

Figure 3:
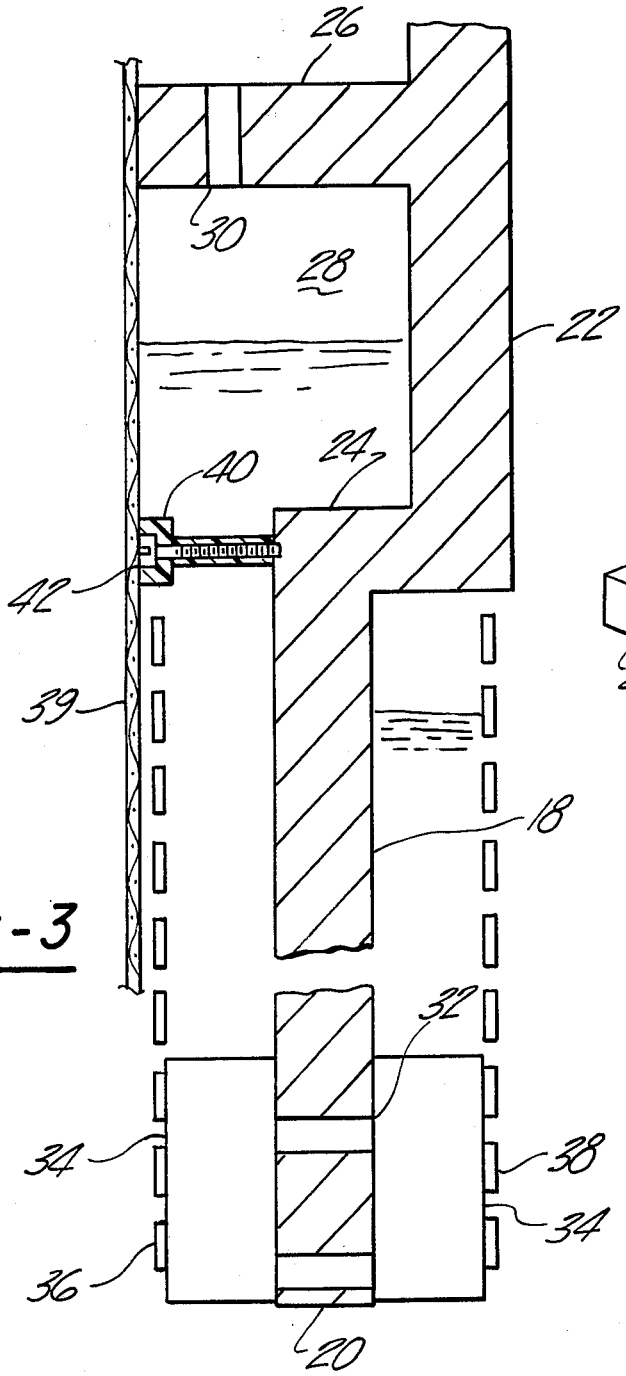
FIG. 3 is a cross-sectional view taken along line 3—3.
Figure 4:
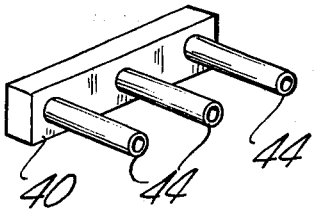
FIG. 4 is a perspective view of the pressure bar.

As clearly shown in FIG. 3, the frame 10 is defined by the central web 18 which is a substantially linear section 20. Integrally molded with the section 20 is a U-shaped section 22 having legs 24, 26. The U-shaped section 22 cooperates with the linear section 20 to define a recessed area 28 between the legs 24, 26 on the anolyte side of the frame 10. Also, the leg 24 defines an upper barrier for the lower zone on the cathode side of the frame. By so constructing the frame a higher liquid level can be maintained on the anode side of the frame than the cathode side.

The leg 26 has a plurality of ports 30 formed therethrough on the anode side of the frame which communicate with external headers to permit gas disengagement in a manner to be described subsequently.

The central web 18 is provided with a plurality of apertures 32. The apertures 32 receive the bipolar connectors 34 therethrough which secure electrodes 36, 38 to the central web. Although any bipolar connector can be effectively used, herein, the central barrier 18 is configured to accommodate the bipolar connector as described in U.S. Pat. No. 3,788,966.

Also, it should be noted that the central barrier is recessed to create electrolyte compartments behind the electrodes when used with a cell separator 39, such as a membrane, diaphragm or the like, in a manner to be described subsequently.

In order to prevent distortion of the cell separator caused by the gases generated on the cathode side of the cell frame and to facilitate withdrawal of the gases, the present invention further includes a pressure bar 40 (FIG. 3). The pressure bar 40 extends across the width of the central web 18 and is disposed on the anode side of the frame. The bar 40 is substantially co-planar with the anode associated therewith.

The pressure bar is formed from any suitable material, such as titanium or the like. The pressure bar is secured to the frame 10 proximate the junction between the section 20 and leg 24, by any suitable means, such as threaded fasteners 42 or the like. The fasteners extend through metallic spacers 44 which maintain a pre-determined distance between the frame proper and the pressure bar. The space between the spacers permits anolyte and anolyte-generated gases to rise to a level within the anode compartment to allow the gases generated to escape through the ports 30.

The cell frame 10 (FIG. 1), further comprises a first pair of laterally spaced apart headers 46. The headers 46 are formed in the periphery of the frame 10 and are in communication with the ports 30, formed in leg 26 on the anode side of the frame. The ports 30 extend between the top of the recess area 28 and transverse openings 48 in communication therewith. Means (not shown) are connected to the transverse openings 48 for withdrawing the anode-generated gases at the end of the filter press module.

The cell frame 10 further includes a second pair of opposed headers 50, connected with the cathode side of the frame. Withdrawal means (not shown) evacuated the cathode-generated gases from the headers 50 at the end of the filter press module. Because the catholyte is generally maintained at a lower level in the lower zone than the anolyte level, the ports 52 open into communication with the lower zone at or near the top of the linear section 20 or central web.

It is to be appreciated that the pairs of headers 46, 50 and the recesed area or open interior 28 cooperate to define the upper zone 14 of the frame 10.

The present cell frame further includes means 56 for feeding the electrolytic feed to the anode side of the frame 10. The means 56 includes a transverse opening 58 and an internal bore 60 extending between the transverse opening 58 and the anode side of the frame.

The means 56 is disposed at the lower zone of the frame and on opposite sides thereof.

Means 62 for withdrawing the catholyte solution is, also, provided in the lower zone 12 and is formed in the peripheral rim. The means 62 comprises a construction analogous to that of the means 56, but has an internal bore 63 opening to the cathode side. In order to facilitate the forming of the instant frame each means 56 and 62 on each side of the frame is provided in a single header 64, 66, respectively.

The present frame further includes a pair of spaced apart bumpers 68, 70. The bumpers are disposed on the bottom of the frame and are integrally formed with the peripheral rim. The bumpers 68, 70 protect the lower or bottom portion of the cell frame during the handling thereof.

Mounted on each lateral side of the frame 10 are handles 72, 74. Each handle includes a shoulder 76, 78. The shoulder portion of the handles seatingly engage and rest upon filter press frame supports conventionally disposed within a filter press cell. The handles, preferably, are integrally formed with the peripheral rim of the frame.

Disposed on each lateral side or face of the frame is a pair of laterally extending projections 80, 82, 84 and 86, respectively. The projections are disposed above and below the handles 72, 74, as shown. Preferably, the projections are integrally formed with the frame, proper. The projections have throughbores 88 extending therethrough.

The projections 80, 82, 84 and 86 support the protection rods (not shown) of the filter press module which extend through the bores 88. As is known to those skilled in the art the protection rods are employed to prevent the possible opening of the press in the event of hydraulic closure failure. The rod, also, holds the remaining frames together in the event the press is broken and when removing a failing frame or cell separator.

As shown in FIGS. 1 and 2, an aperture 90 is provided between the laterally spaced apart headers 46. The aperture 90 is utilized to lift the frame 10 during assembly of the filter press cell module.

Although not shown in the drawing, the frame 10 contemplates the sealing thereof with a gasketing secured to the frame about the periphery thereof. Separate gaskets can be deployed about the headers. The peripheral gasketing is provided on both sides of the frame. It is to be appreciated that the peripheral gasketing eliminates internal leaks, since any leaks would occur at the outer edges of the frame. Thus, the leaks could be visually detected.

It is contemplated that in practicing the present invention, the central web 18 is devoid of any electrode support nubs or the like. Rather, the electrodes 34, 36 comprise stiffened, segmented electrodes such as described in copending U.S. patent application Ser. No. 535,321, filed Dec. 23, 1974, and entitled "Self Supporting Electrodes for Chlor-Alkali Cell."

The present cell frame 10 is perfectly amenable in a bipolar diaphragm filter press cell wherein the separator 39 is a diaphragm held in place and sealed at the periphery of two adjacent frames in the module.

The separator 39 can comprise any suitable construction, such as a polymeric sheet diaphragm, deposited and fused synthetic fiber diaphragm, ion exchange membrane or the like.

It is to be further appreciated that the present cell frame 10 is "universal" in that it is adaptable for a plurality of electrolytic processes including diaphragm cell processes and membrane cell processes, such as electro-organic synthesis.

For example, as a diaphragm cell for the production of chlorine and caustic, brine is fed into the anolyte compartment through means 56. Chlorine is removed at the upper zone from the headers 46. By employing a chlorine back pressure there is a sufficient pressure differential between the anolyte and catholyte compartments to cause hydraulic flow through the diaphragm. The week cell liquor is exhausted through the means 60 via a perk-arm system. Hydrogen is exhausted through headers 50.

As a membrane cell for the production of chlorine and caustic the brine feed is introduced to the anolyte compartment through the means 56. Deionized or distilled water is entered into the catholyte compartment via means 62, if required. Chlorinated anolyte and chlorine gas are exhausted through the headers 46, and hydrogen gas and caustic are exhausted through headers 50.

The same frame is equally applicable to the production of sodium dithionite and chlorine using either a membrane or a diaphragm as well as electrochemical synthesis. This is because of the ability to independently feed and/or exhaust the anolyte and catholyte compartments.

In using the present cell frame in a module for electroorganic synthesis, a suitable separator 39 is utilized and the electrolytes are independently fed to both electrode compartments.

The cell frame of the present invention provides utmost consideration to the economics involved in electrolytic process by providing maximum production per unit floor space utilized. In a practicable embodiment hereof the frame has overall dimensions of about 2.0 × 1.36 meters with a thickness of 7.6 centimeters. Such dimensions permit the height of the electrode compartment to be about 1.55 meters. However, smaller dimensions could be imparted to the frame hereof. In constructing a filter press module from about 20 to 50 of the instant frames are deployed.

It should also be noted that even with the sizes accorded to present frames the phenomenon of "gas blinding" can be eliminated. This would be achieved by pressurizing the gases above the liquid level in a manner well known.

Having thus described the invention what is claimed is:

1. A cell frame for a bipolar electrolytic filter press cell, comprising:

a. a peripheral rim, b. a first linear section defining a central web recessedly disposed within the rim, one side of the web defining a catholyte side and the other an anolyte side, c. a U-shaped section integrally formed with the linear section and cooperating therewith to define a recessed area communicating with the anolyte side above the first linear section, the recessed area extending away from the anolyte side of the central web, d. the portion of the frame extending from the top of the central web downwardly defining a lower zone at which electrolysis is carried out, e. the portion of the frame extending upwardly from the top of the central web defining an upper zone for disengaging the electrolysis-generated gases, and f. means for preventing distortion of the central web and facilitating disengagement of the gases disposed between the upper zone and the lower zone on the anolyte side of the frame.

2. The cell frame of claim 1 which further comprises: at least one header in communication with the recessed area and at least one header in communication with the cathode compartment, the headers and the recessed area defining the upper zone.

3. The cell frame of claim 2 wherein the disengagement means comprises a pressure bar, disposed on the anolyte side of the web and extending thereacross, the bar having a plurality of spacers disposed between the bar and the linear section such that the anolyte-generated gases rise therethrough into the recessed area.

4. The cell frame of claim 2 which further comprises: a pair of headers, one on each lateral side of the barrier, and formed in the upper zone, the headers communicating with the anolyte side to disengage the gases therefrom.

5. The cell frame claim 4 wherein the pair of anolyte associated headers are formed in the peripheral rim.

6. The cell frame of claim 1 which further comprises:

a. a handle formed on each lateral side of the frame, each handle seatingly engaging a filter press frame support, b. at least one projection on each lateral side of the frame, the projections supporting the filter press protection rods, and c. means for facilitating the lifting of the frame formed at the top thereof in the rim.

7. The cell frame of claim 1 which further comprises:

a. means for feeding electrolyte solution to the anolyte side of the barrier, the means being formed in the rim, b. means for feeding electrolyte solution to the catholyte side of the barrier, the means being formed in the rim, c. means for exhausting catholyte liquid product from the catholyte side of the barrier and being formed in the rim, and d. means for exhausting anolyte liquid product from the anolyte side of the barrier and being formed in the rim, the means for feeding and the means for exhausting being disposed in the lower zone.

8. In a chlor-alkali bipolar electrolytic filter press cell frame having a central web, a pressure bar therefor comprising:

a. an elongated member having a length substantially equal to the width of the web of the cell frame, and b. a plurality of spacers extending outwardly from the elongated member, the spacers maintaining a predetermined distance between the elongated member and the frame.

9. The cell frame of claim 8 which further comprises: means for fastening the elongated member to the cell frame.

10. The cell frame of claim 9 wherein the means for fastening extend through the spacers.

11. The cell frame of claim 8 wherein the pressure bar is formed from titanium.

12. In combination with a cell frame having a central web for a bipolar electrolytic filter press cell, a pressure bar for preventing distortion of the frame and for facilitating disengagement of the gases evolved in the cell, the pressure bar comprising:

a. an elongated member having a length substantially equal to the width of the web of the cell frame, and b. a plurality of spacers extending outwardly from the elongated member, the spacers maintaining a predetermined distance between the elongated member and the frame.

13. The combination of claim 12 which further comprises:

means for fastening the elongated member to the cell frame.

14. The combination of claim 13 wherein the means for fastening extends through the spacers.

15. The pressure bar of claim 12 wherein the pressure bar is formed from titanium.

* * * * *